United States Patent [19]

Smolinski

[11] 4,449,899

[45] May 22, 1984

[54] ROTARY VANE MACHINE

[75] Inventor: Ronald E. Smolinski, Dayton, Ohio

[73] Assignee: Ecton Corp., Dayton, Ohio

[21] Appl. No.: 373,077

[22] Filed: Apr. 29, 1982

[51] Int. Cl.[3] ..... F04C 18/00

[52] U.S. Cl. ..... 418/255; 418/257

[58] Field of Search ..... 418/137, 138, 241, 253, 418/254, 255, 257

[56] References Cited

U.S. PATENT DOCUMENTS

| | | | |
|---|---|---|---|
| 1,922,797 | 8/1933 | Eyston | 418/254 |
| 2,413,935 | 1/1947 | Williams | 418/254 |
| 3,323,501 | 6/1967 | Balve | 418/241 |

*Primary Examiner*—Leonard E. Smith

*Assistant Examiner*—Jane E. Obee

*Attorney, Agent, or Firm*—Biebel, French & Nauman

[57] ABSTRACT

A rotary vane machine includes a stator housing having an inner surface defining a stator chamber and inlet and outlet ports, a substantially cylindrical rotor rotatably mounted within the chamber, a crank axle rotatably mounted within the chamber and including a plurality of crank pins offset from an axis of rotation of the crank axle, and a plurality of vane pairs. Each vane pair includes two opposing vane members slidably received in the rotor and means for connecting the opposing vane members together and rotatably connecting the vane pair to a different one of the crank pins. Rotation of the crank axle causes the vane pairs to rotate and urge against the rotor, thereby rotating the rotor.

6 Claims, 10 Drawing Figures

ROTARY VANE MACHINE

BACKGROUND OF THE INVENTION

1. Field of the Invention

The present invention relates to rotary machines and, more particularly, to rotary machines of the type having vanes which slide relative to a rotor.

2. Prior Art

Rotary vane machines typically include a stator housing having an inner surface defining a stator chamber and inlet and outlet ports, a rotor, and a plurality of vanes. The rotor is rotatably mounted within the stator chamber and supports the vanes for rotation while permitting them to slide relative to the rotor in order to maintain contact between the tips of the vanes and the inner surface of the stator housing. In machines of this type, the rotor typically is mounted for rotation about an axis which is off-center or eccentric with respect to the stator chamber so that the outer surface of the rotor, the surfaces of the vanes, and the inner surface of the stator chamber define discrete chambers which vary volumetrically as the rotor rotates within the stator housing.

Many mechanisms have been employed to position the vanes properly with respect to the rotor so that the vanes will slide in a radial direction with respect to the rotor to maintain contact with the inner surface of the stator chamber and form the desired discrete chambers within the stator housing. For example, U.S. Pat. No. 2,314,056 discloses a rotary vane vacuum pump or compressor having a cylindrical stator housing within which is mounted a hollow inner body having a cylindrical internal surface. A hollow, cylindrical driving member is rotatably mounted within the inner body and defines pairs of opposing slits which slidably receive vanes. The vanes are connected to each other such that rotation of the cylindrical driving member causes the vanes to rotate and to slide with respect to the driving member. The driving member is mounted within the hollow inner body so that it is off-center from a central axis of the inner body.

The vanes extend from and retract into the cylindrical driving member so that they form discrete chambers within the hollow inner body which are defined by the vane surfaces, the outer surface of the driving member, and the inner surface of the inner body. The vanes comprise a first vane member which is H-shaped and a second vane member which is substantially rectangular with a rectangular opening formed in its center. The two vane members are connected by a crank arrangement consisting of journals and connecting rods. A disadvantage of this device lies in the fact that it is designed only to accommodate two sets of opposing vanes and does not lend itself to applications requiring more than two sets of vanes.

U.S. Pat. No. 2,781,729 discloses a fluid pump comprising a housing which is circular in cross section and a rotor which is rotatably mounted within the housing. The rotor includes slots which slidably receive sets of vanes which in turn are rotatably mounted to sleeves. The sleeves are carried on bearings which rotate about eccentric bearing bosses. The bearing bosses are rotated by a shaft whose end is disposed within the housing.

The pairs of vanes are rigidly connected to each other by the sleeves and are disposed within the housing such that the pairs of vanes are spaced about a central axis of a drive shaft. During operation of the pump, the vanes oscillate or swing relative to the sleeves which carry them. This oscillating movement is undesirable in that it accelerates wear between the parts and shortens the operating life of the pump.

Another example is shown in U.S. Pat. Nos. 1,940,384 and 1,637,484. Each patent discloses a rotary machine having a rotor mounted eccentrically within a substantially cylindrical chamber and which defines slots which slidably receive vanes which are carried on a central shaft, also mounted eccentrically within the chamber. In the device disclosed in the former patent, the vanes are joined to form pairs by members which define oblong slots extending along a centerline of the vane pairs. During operation of this machine, the central shaft oscillates within the oblong slots of the joining members.

In one embodiment of the latter patent, the vanes are also grouped in opposing pairs and are joined by members which define oblong slots. However, these oblong slots are oriented perpendicularly to the slots of the former patent. During operation of this machine, the drive shaft oscillates within the slots.

The two rotary machines disclosed in these patents each have members which join vanes together in pairs and define slots within which the central drive shaft oscillates. This oscillating movement during operation creates excessive wear between the two parts, thereby shortening the useful life of the machine.

Accordingly, there is a need for a rotary vane machine with few working parts to reduce the cost of fabrication, but which can also accommodate more than two sets of vanes. There is also a need for a rotary vane machine having pairs of vanes joined by connecting members and driven by engagement with a central drive shaft which reduces or eliminates oscillating movement between the central drive shaft and the connecting members to reduce wear and extend the useful life of the apparatus.

SUMMARY OF THE INVENTION

The present invention provides a rotary vane machine having a stator housing with an inner surface defining a stator chamber and defining inlet and outlet ports through the housing into the chamber, a substantially cylindrical rotor rotatably mounted within the chamber, a crank axle rotatably mounted within the chamber and including a plurality of crank pins offset from an axis of rotation of the crank axle, and a plurality of vane pairs, each including two opposing vane members slidably received in the rotor and having means for connecting the opposing vane members together and rotatably connecting the vane pair to a different one of the crank pins. The stator housing includes a cylindrical wall, defining inlet and outlet openings, and a pair of end plates. The rotor and crank axle are mounted eccentrically within the stator housing such that the axis of rotation of the crank axle is located between the axis of rotation of the rotor and the central axis of the stator housing. The vane pairs are sized to protrude from an outer surface of the rotor and terminate adjacent the inner surface of the stator housing, preferably providing a clearance with the stator housing which is on an order of magnitude equal to the design tolerances.

The crank pins of the crank axle are all displaced the same radial distance from the axis of rotation of the crank axle and are evenly spaced about the axis. Thus, for a crank axle having three crank pins, the crank pins would be spaced 120° apart. The vane pairs include connecting rods which are rotatably mounted to a different one of the crank pins by roller bearings such that each crank pin passes through the center of a vane pair. The spacing of the crank pins about the axis of rotation of the crank axle and the positioning of the connection between the crank pin and the vane pair provide a balanced system in which centrifugal forces are equal and opposite, thereby eliminating unbalanced forces and torques which could cause excessive wear on the rotary vane machine.

The rotor preferably comprises a plurality of rotor segments which are identical to one another in size and shape and are positioned between the vane members of the vane pairs. The rotor segments are held in position by a pair of mounting rings which are mounted to the ends of the rotor. The mounting rings are rotatably mounted to the end plates of the stator housing and thus support the rotor for rotation therein. In operation, the crank axle is rotated by an external motor, such as an electric motor or a turbine, causing the crank pins to rotate about the axis of the crank axle. This movement of the crank pins causes the vane pairs to rotate within the stator housing and urge against the rotor segments. The urging force causes the rotor segments to rotate with the vane pairs.

Due to the geometry of the linkage between the crank axle and the vane pairs, the vane pairs make a complete revolution within the stator housing for every two revolutions of the crank axle. This inherent gear reduction feature makes the rotary vane machine of the present invention particularly appropriate for use in combination with high-speed driving means, such as gas-driven turbines having high rotational speeds.

Accordingly, it is an object of the present invention to provide a rotary vane machine having few moving parts to reduce wear and fabrication costs, but which also has a plurality of vane pairs; a rotary vane machine in which there is no oscillating movement between parts; a rotary vane machine having vanes mounted on a crank axle in symmetric pairs to reduce torques and unbalanced loading of the crank axle; a rotary vane machine in which the vanes are rotatably mounted to a central crank axle and do not rely upon frictional engagement with the inner surface of the stator housing for location relative to the rotor; and a rotary vane machine which effects an inherent gear reduction to facilitate its use with high-speed drive means.

Other objects and advantages of the invention will be apparent from the following description, the accompanying drawings and the appended claims.

DETAILED DESCRIPTION OF THE PREFERRED EMBODIMENT

Figure 1:
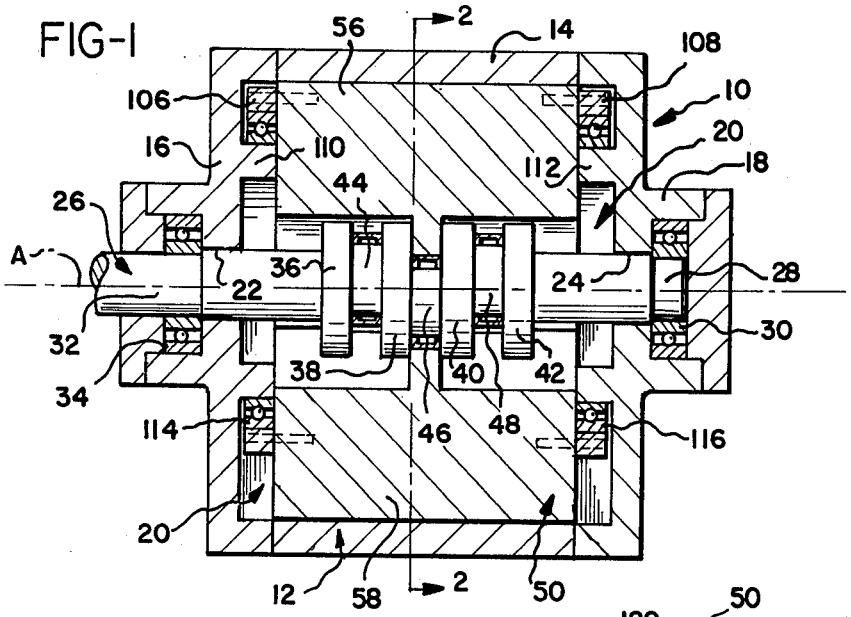
FIG. 1 is a side elevation in section of a preferred embodiment of the rotary vane machine of the present invention.
Figure 2:
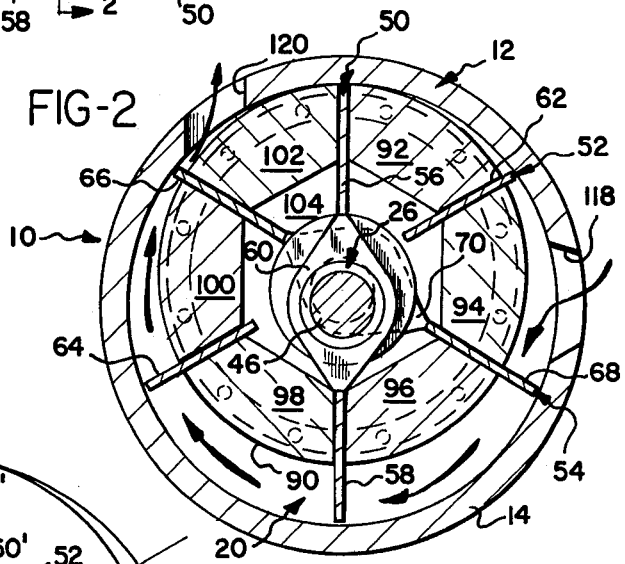
FIG. 2 is an end elevation in section of the preferred embodiment, taken at line 2—2 of FIG. 1.

As shown in FIGS. 1 and 2, the rotary vane machine of the present invention, generally designated 10, comprises a stator housing 12 having a substantially cylindrical wall 14, and end pieces 16, 18. The cylindrical wall 14 and end pieces 16, 18 may be welded or bolted together and define a substantially cylindrical stator chamber 20.

The end pieces 16, 18 of the stator housing 12 define openings 22, 24, respectively, which are offset from the central axis of the stator chamber 20. A crank axle 26 is rotatably mounted within the openings 22, 24. The outer end 28 of the crank axle is supported within the end piece 18 by roller bearings 30, and the inner end 32 of the crank axle is supported within end piece 16 by roller bearings 34. The inner end 32 of the crank axle 26 preferably includes means (not shown) providing a driving connection to a motor such as an electric motor or gas-driven turbine.

Figure 4A:
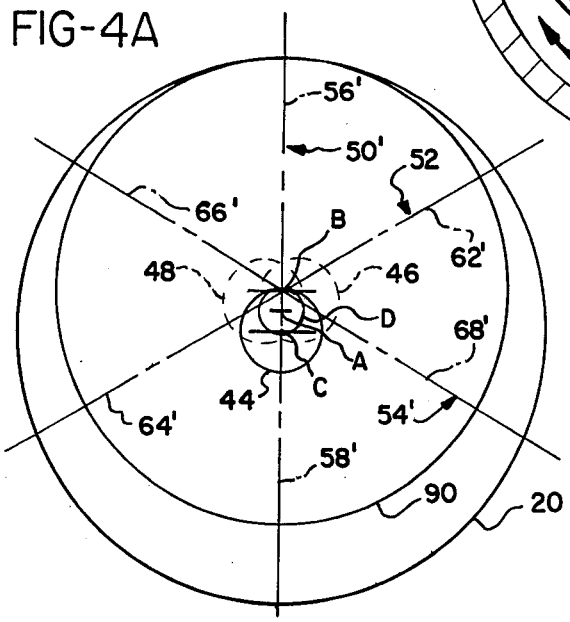
FIG. 4A is a schematic diagram of the preferred embodiment of the invention, showing the relative positions of the vane pairs, crank pins, and rotor.
Figure 4B:
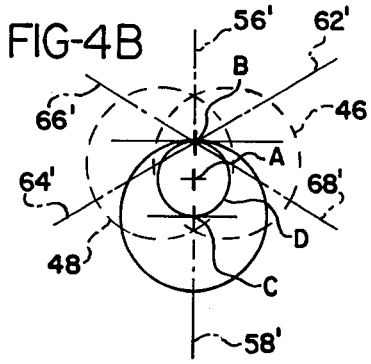
FIG. 4B is an enlarged detail of the center of the diagram of FIG. 4A.

The crank axle 26 includes crank arms 36, 38, 40, 42, which are preferably disc-shaped. Crank arms 36, 38, 40, 42 support crank pins 44, 46, 48. Crank pins 44, 46, 48 are offset from the central or rotational axis of the crank axle 26, denoted by line A, and are spaced evenly about the axis. Thus, for the embodiment shown, the crank pins 44–48 are spaced at 120° intervals about axis A, as best shown in FIGS. 4A and 4B.

Figure 3:
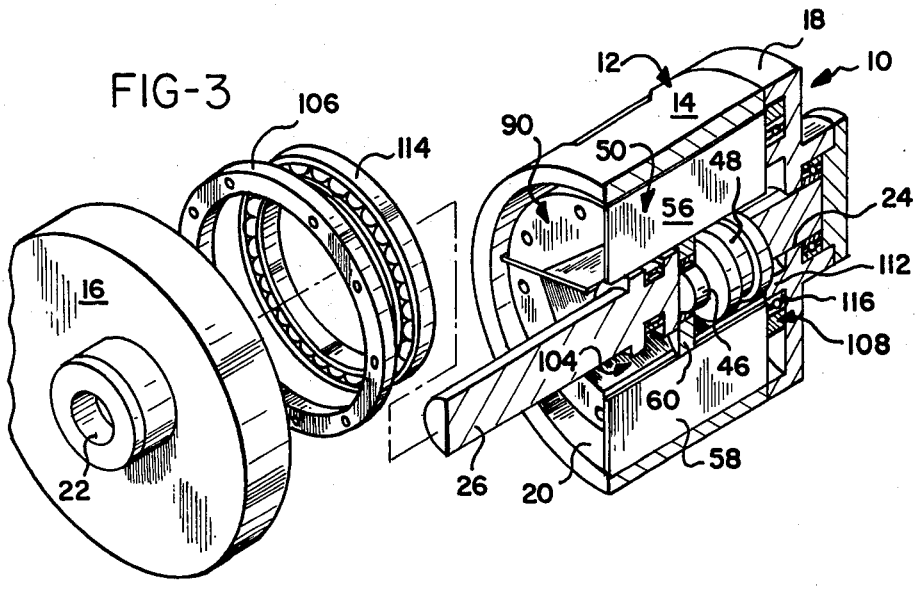
FIG. 3 is a partially exploded perspective view of the preferred embodiment of the present invention, in which the stator housing and crank axle are shown in section.

As shown in FIGS. 1, 2, and 3, vane pairs 50, 52, and 54 are mounted within the stator chamber 20. Vane pair 50 includes a pair of opposing vane members 56, 58 which are joined together by a connecting member 60 which is rotatably mounted to crank pin 46.

Similarly, vane pair 52 includes vane members 62, 64 which are joined by a connecting member (not shown) to crank pin 44. Vane pair 54 includes opposing vane members 66, 68 which are joined by a connecting member 70 to crank pin 48.

The construction of the vane pairs 52, 54, and their respective connecting members which join them to each other and to crank pins 46, 48, are identical to that of vane pair 50 and connecting member 60. Accordingly, the following discussion will be limited to vane pair 50, with the understanding that the description applies equally to the other vane pairs 52, 54.

Figure 5:
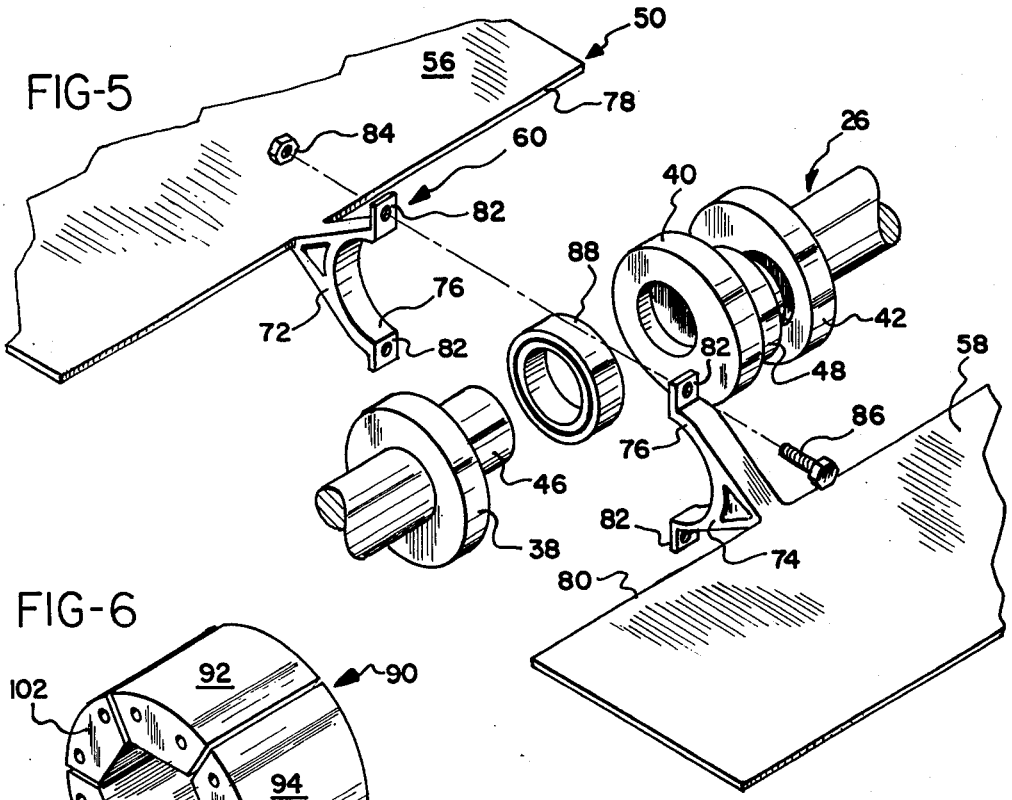
FIG. 5 is an exploded detail view of a vane pair and the crank axle of the preferred embodiment of the invention.

As shown in FIGS. 3 and 5, the vane members 56, 58 of vane pair 50 are generally thin and plate-like, have a rectangular shape and are substantially identical in size to each other. The connecting member 60 includes connecting brackets 72, 74, each of which defines a semi-circular cut-out 76. The connecting brackets 72, 74 extend inwardly from the roots 78, 80 of the vane members 56, 58, respectively. The connecting brackets 72, 74 each include opposing flanges 82 such that the opposing flanges of bracket 72 may be connected to the flanges of connecting bracket 74 by nuts and bolts 84, 86.

The semi-circular cut-outs 76 are sized to enclose a roller bearing element 88 which is fitted onto the crank pin 46. Thus, the vane pair 50 is rotatably mounted to the crank pin 46 at the mid-point of the vane pair.

Figure 6:
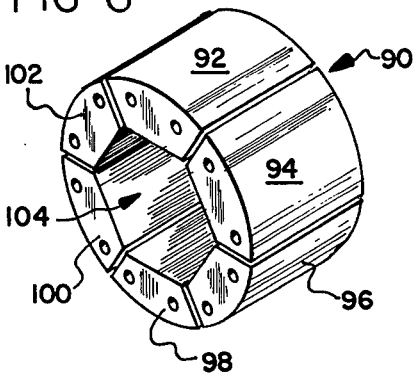
FIG. 6 is a perspective view of the rotor of the preferred embodiment.

As shown in FIGS. 2, 3, and 6, the rotary vane machine 12 also includes a rotor 90 which comprises six rotor segments 92, 94, 96, 98, 100, 102. The rotor 90 is generally cylindrical in shape and defines a central bore 104 through which passes the crank axle 26. The rotor segments 92, 94, 96, 98, 100, 102 are identical to each other in shape and size and are positioned between the vane members 56, 58, 62, 64, 66, 68 of the vane pairs 50, 52, 54.

As best shown in FIGS. 1 and 2, the rotor segments 92–102 are joined to each other by rings 106, 108 which are bolted to both ends of the rotor segments. End piece 16 defines a raised, annular boss 110 and end piece 18 defines a raised, annular boss 112. Annular bosses 110, 112 receive roller bearings 114, 116 about their exteriors which in turn receive the rings 106, 108, respectively, of the rotor 90. Thus, the rotor 90 is rotatably mounted within the stator chamber 20 on raised annular bosses 110, 112.

As shown in FIGS. 4A and 4B, the central axis of the rotor 90, designated by point B, is offset from the central axis of the cylindrical stator chamber 20, designated by point C. The central axis of the crank axle, designated by point A, is positioned in between the axis B and the axis C of the rotor 90 and stator housing 20, respectively. It is also apparent from FIGS. 4A and 4B that the axis A of the crank axle lies on a line which intersects the axis B and axis C. The crank pins 44, 46, 48 are shown offset from and evenly spaced about the central axis A of the crank axle.

When the crank axle is rotated, the centers of the crank pins 44, 46, 48 describe a circle D whose center is axis A. The vane members 56', 58', 62', 64', 66', 68', separated by the rotor segments 92–102 (FIG. 6), are evenly spaced about the axis B of the rotor. It should be noted that, while the crank axle and crank pins 44, 46, 48 rotate about axis A, the centerlines of the vane pairs 50', 52', 54' pass through, and rotate about, rotor axis B.

The result of the eccentricities of the axes of the crank axle 26, rotor 90, and crank pins within the stator chamber 20 is shown in FIG. 2. The vane pairs 50, 52, 54 project beyond the outer surfaces of the rotor segments 92–102 and terminate adjacent the inner surface of the cylindrical wall 14 of the stator housing 12. Thus, the vane pairs 50, 52, 54 form discrete chambers within the stator chamber 20 which are bordered by the outer surface of the rotor segments 92–102 and the inner surface of the stator housing 12. Since the rotor 90 is positioned eccentrically within the stator housing 12, the volume of each discrete chamber is different from the volume of the chambers immediately adjacent to it. Thus, by forming an inlet orifice 118 in the cylindrical wall 14 opposite rotor segment 94, as seen in FIG. 2, and forming an outlet orifice 120 in the cylindrical wall opposite the rotor segment 102, the rotary vane machine 10 may be operated to act as a compressor.

The volume of the chamber communicating with inlet orifice 118, which in FIG. 2 is bordered by rotor segment 94 and vane members 62 and 68, has a greater volume than the chamber communicating with outlet orifice 120 which is defined by rotor segment 102 and vane members 66 and 56.

However, if the outlet orifice 120 was positioned so that, as seen in FIG. 2, it communicated with the chamber defined by rotor segment 100 and vane members 64 and 66, the volume of the resulting chamber would equal that communicating with inlet orifice 118, and the machine 10 would operate as a pump only. Other operating characteristics can be achieved by positioning the inlet and outlet orifices 118, 120 at locations in the stator housing 12 other than that shown in FIG. 2.

In operation, as best shown in FIGS. 1 and 2, the crank axle 26 is rotated by an external motor (not shown) thereby causing the crank pins 44, 46, 48 to orbit about the central axis A of the crank axle. The orbital motion of the crank pins 44, 46, 48 causes the vane pairs 50–54 to rotate about the central axis A of the crank axle, as well as the centers of the crank pins 44, 46, 48. This rotational movement urges the vane pairs 50–54 against the rotor segments 92–102 causing the rotor 90 to rotate with the vane pairs.

The rotary motion of the vane pairs 50–54 causes air or other compressible gas entering through inlet orifice 118 to be transported in the discrete chamber defined by rotor segment 94 and vane members 62 and 68 from a position adjacent the inlet orifice to the outlet orifice 120, assuming a clockwise rotation of the vane pairs within the stator housing 12 as shown in FIG. 2. As the crank axle 26 rotates, the vane pairs 50–54 are displaced about the stator chamber 20 such that their tips remain adjacent the inner surface of the stator housing 14. The vane members 56, 58, 62, 64, 66, 68 thus slide radially outwardly and inwardly between adjacent rotor segments 92–102 as they progress about the interior of the stator housing 14.

Figure 7A:
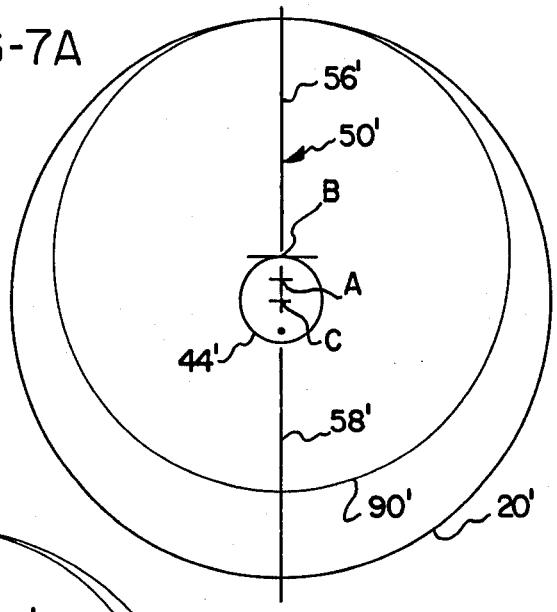
FIGS. 7A, 7B and 7C are schematic diagrams showing the position of a vane set relative to its associated crank pin during a revolution of the crank axle.
Figure 7B:
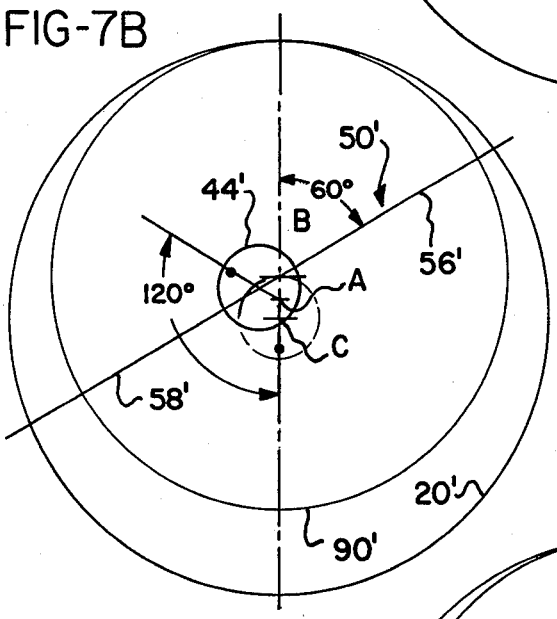
Figure 7C:
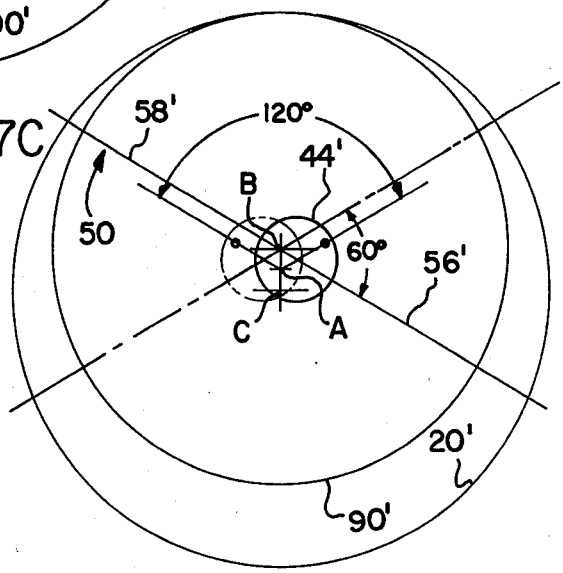

It should also be noted that, during rotation of the crank axle, the vane pairs rotate not only with respect to the stator housing, but with respect to the crank pins of the crank axle as well. For example, FIGS. 7A–7C show the position of vane pair 50' relative to crank pin 44' within stator housing 20'. In FIG. 7A, vane pair 50' is substantially vertical within stator housing 20', with vane member 56' at the 12 o'clock position and pin 44' and vane member 58' at the 6 o'clock position. In FIG. 7B, the crank axle has rotated 120° clockwise, thus rotating the pin 44' the same amount about the axis A. However, vane pair 50', constrained by rotor 90', has rotated only 60°.

Similarly, in FIG. 7C, the axle and pin 44' have been rotated 240° from their position in FIG. 7A and 120° from their position in FIG. 7B, while the vane pair 50' has been rotated only 120° from its starting position in FIG. 7A and 60° from its position in FIG. 7B. When the pin 44' has been rotated back to its position shown in FIG. 7A, a full 360°, the vane pair 50' has been rotated only 180°, and would appear inverted relative to its orientation in FIG. 7A, with vane member 58' at the 12 o'clock position and vane member 56' at the 6 o'clock position.

Thus, for each complete revolution of the crank axle 26, the vane pairs 50–54 make one-half revolution, resulting in a speed reduction of 1:2. This inherent speed reduction characteristic makes the rotary vane machine of the present invention particularly suited for high-speed driving means such as turbines.

The rotary vane machine may also function as an air motor in which compressed air or other compressed gas is used as the working fluid. For such operation, the compressed gas would be forced into either the inlet orifice or outlet orifice of the stator housing, whereupon the gas would expand against the surfaces defining the chamber adjacent the orifice. This expansive force would cause the vane pairs to rotate, thereby rotating the crank axle. For example, if compressed gas were forced into the inlet orifice 118 of the machine 10 as shown in FIG. 2, the gas would expand within the chamber against rotor segment 94 and vane members 62 and 68, resulting in a net force causing the vane pairs 50–54 to rotate in a clockwise direction. The clockwise rotation would be due to the greater surface area of vane member 68 forming a portion of the chamber than is provided by vane member 62.

The rotary vane machine preferably is fabricated from steel, aluminum, or other metal. The crank axle may be case hardened to provide favorable wear characteristics. However, the crank axle as well as the crank pins are separated from the structure against which they rotate by rolling element bearings. The vane pairs should be made of a material which is compatible with the material comprising the rotor segments from a friction or wear standpoint.

Since the engagement of the tips of the vane pairs with the inner surface of the stator housing is not used to constrain the radial movement of the vane members relative to the rotor segments, there is no need for special hardening treatment of the tips of the vane pairs to prevent rapid wear. It is preferable to provide a slight clearance between the inner surface of the stator housing and the tip of the vane members to extend the life of these two components. The clearance must be minimized to reduce gas leakage to a negligible amount.

While the form of apparatus herein described constitutes a preferred embodiment of this invention, it is to be understood that the invention is not limited to this precise form of apparatus, and that changes may be made therein without departing from the scope of the invention.

What is claimed is:

1. A rotary vane machine comprising:

a stator housing having an inner surface defining a substantially cylindrical stator chamber having a central stator axis, and having inlet and outlet ports through said housing into said chamber;

a substantially cylindrical rotor mounted within said chamber for rotation about a rotor axis offset from said stator axis;

a crank axle having a crank axis and including a plurality of crank pins offset from said crank axis;

means for rotatably mounting said crank axle within said chamber such that said crank axis is offset from said stator and rotor axes; and a plurality of vane pairs, each of said vane pairs including two opposing vane members slidably received in said rotor, and means for connecting said opposing vane members together and rotatably connecting said vane pairs to different ones of said crank pins, whereby rotation of said crank axle causes said vane pairs to rotate, said vane members urging against and thereby rotating said rotor.

2. The rotary vane machine of claim 1 wherein said crank axis is located between said rotor axis and said stator axis and said vane members protrude beyond said rotor toward said inner surface to define a plurality of discrete volumes of varying size.

3. The rotary vane machine of claim 2 wherein said crank pins are located the same radial distance from and are evenly spaced about said crank axis.

4. The rotary vane machine of claim 3 wherein said vane members each include a vane tip and said vane members are sized such that said vane tips do not contact said inner surface.

5. The rotary vane machine of claim 4 wherein said rotor includes a plurality of rotor segments, each of said segments separating a pair of adjacent vane members.

6. The rotary vane machine of claim 5 wherein said rotor includes means for joining said segments together.

* * * * *